US006213551B1

(12) United States Patent
Desnoyers et al.

(10) Patent No.: US 6,213,551 B1
(45) **Date of Patent: *Apr. 10, 2001**

(54) CHAIR LOCKING MECHANISM

(75) Inventors: Charles Desnoyers, St-Pie; Pierre Bellefleur, Magog; Éric Fontaine, St-Liboire, all of (CA)

(73) Assignee: Dutailier International Inc., St-Pie (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/056,529

(22) Filed: Apr. 7, 1998

(51) Int. Cl.[7] ..... A47C 3/02; A47C 3/03

(52) U.S. Cl. ..... 297/270.4; 297/270.2; 297/270.3; 297/370

(58) Field of Search ..... 297/270.1, 262.1, 297/270.2, 270.3, 281, 282, 370, 371; 248/370

(56) References Cited

U.S. PATENT DOCUMENTS

| | | | | |
|---|---|---|---|---|
| 108,255 | | 10/1870 | Gravitz . | |
| 712,743 | | 11/1902 | Van Slyke . | |
| 1,043,112 | * | 11/1912 | Kronheim et al. | 297/282 |
| 1,421,260 | * | 6/1922 | Kurnick | 297/270.3 |
| 1,555,689 | * | 9/1925 | Miller | 297/262.1 |
| 2,284,571 | * | 5/1942 | Heller | 248/370 |
| 2,302,387 | * | 11/1942 | Greeno et al. | 248/370 |
| 3,093,409 | | 6/1963 | Fletcher . | |
| 3,826,532 | | 7/1974 | Caldemeyer . | |
| 3,897,104 | | 7/1975 | Black . | |
| 3,904,240 | | 9/1975 | Rogers, Jr. . | |
| 4,092,041 | | 5/1978 | Landry . | |
| 4,123,102 | | 10/1978 | Landry . | |
| 4,154,475 | | 5/1979 | Shoemaker . | |
| 4,411,468 | | 10/1983 | Apissomian . | |
| 4,534,591 | | 8/1985 | Parker . | |
| 4,707,025 | | 11/1987 | Rogers, Jr. . | |
| 4,957,302 | | 9/1990 | Maxwell . | |
| 5,527,095 | | 6/1996 | Marshall . | |

* cited by examiner

*Primary Examiner*—Anthony D. Barfield
(74) *Attorney, Agent, or Firm*—Ladas & Parry

(57) ABSTRACT

A locking mechanism for chairs such as gliding and rocking chairs comprises a toothed rack for connection to the chair seat with the rack oriented generally in the direction of movement of the chair seat relative to the base and the teeth extending along the rack and facing towards a pin that is carried in the base. The rear end of the rack is pivoted to the chair seat and the front end of the rack is connected to a pivoting linkage arrangement operated by a lever at the side of the chair seat. Operation of the lever is effective to swing the toothed rack from a retracted position to a lowered position wherein the locking pin is engaged by a registering tooth in the rack. The attitude of the chair in the locked position will depend upon the position of the locking interengagement between the pin and the toothed rack.

16 Claims, 4 Drawing Sheets

CHAIR LOCKING MECHANISM

BACKGROUND OF THE INVENTION a) Field of the Invention

This invention relates to a new or improved locking mechanism for chairs and to a chair incorporating such locking mechanism. The invention is particularly although not exclusively useful with rocking and gliding arm chairs.

b) Description of the Prior Art

Numerous chair mechanisms have been proposed over the years for providing a rocking motion or a rocking and gliding motion of the chair seat, and frequently such chairs include mechanisms for locking the chair seat in a desired position relative to the chair base. Mostly these mechanisms are of considerable complexity, see for example U.S. Pat. No. 5,527,095 Marshall et al and U.S. Pat. No. 3,904,240 Rogers et al. A relatively simple locking mechanism is shown in U.S. Pat. No. 3,836,532 Caldemeyer wherein an upstanding rod pivoted to the base has serrations in its rear edge which are engageable with a pin mounted in a bracket that is affixed to the chair seat portion. A cam that is operated by a lever at the side of the seat can be swung into a position to hold the serrated rod in engagement with the pin. However this mechanism is relatively flimsy and it is doubtful that it could provide adequate resistance to the high disengagement forces which could be imposed upon the locking mechanism.

The aim of the present invention is to provide an improved locking mechanism is through a comparatively simple structure provides a strong and reliable locking action, and furthermore is convenient and easy for the occupant of the chair to utilize.

SUMMARY OF THE INVENTION

The present invention provides a locking mechanism for a chair having a base for supporting the chair on a floor and a chair seat positioned generally above the base and supported for movement thereon by a linkage connection, the locking mechanism being operable to immobilize said chair seat relative to said base, said locking mechanism comprising: a pin for attachment to one of said base and said seat and an elongate rack for attachment to the other of said base and said seat, said rack defining an array of teeth spaced along its length and presented towards said pin, said rack in use extending generally in a direction of movement of said chair relative to said base and being of such length that throughout at least a major part of said movement, said pin lies in register with said array of teeth; and an actuating mechanism selectively operable to effect relative movement of said pin and said rack towards one another to engage said pin with a registering tooth of said rack and thus lock said seat with respect to said base.

The rack is preferably pivotally attached at one end to the seat, the second end of the rack being swingable by a linkage mechanism to pivot the rack into or out of engagement with the pin on the base. The operating mechanism preferably comprises a lever handle carried on a pin and connected to a pair of pivoted strut links which can be moved through operation of the lever from a folded retracted position to at over center extended position. In the extended position the rack is advanced towards the pin to engage the latter with one of its teeth.

The above described locking mechanism is suitable for inclusion in many forms of chairs, and is particularly suitable for use in the kind of chair known as a gliding and rocking chair. The mechanism preferably includes a pin of substantial diameter, e.g. greater than ¼ inch, and preferably about ½ inch, engageable in deep teeth of corresponding size in the rack, this engagement providing a sufficient bearing surface to effect a secure locking action. For large chairs, and in particular for wide seating furniture such as sofas, the locking mechanism can be duplicated at opposite sides of the furniture.

BRIEF DESCRIPTION OF THE DRAWINGS

The invention will further be described, by way of example only, with reference to the accompanying drawings wherein.

Figure 1:
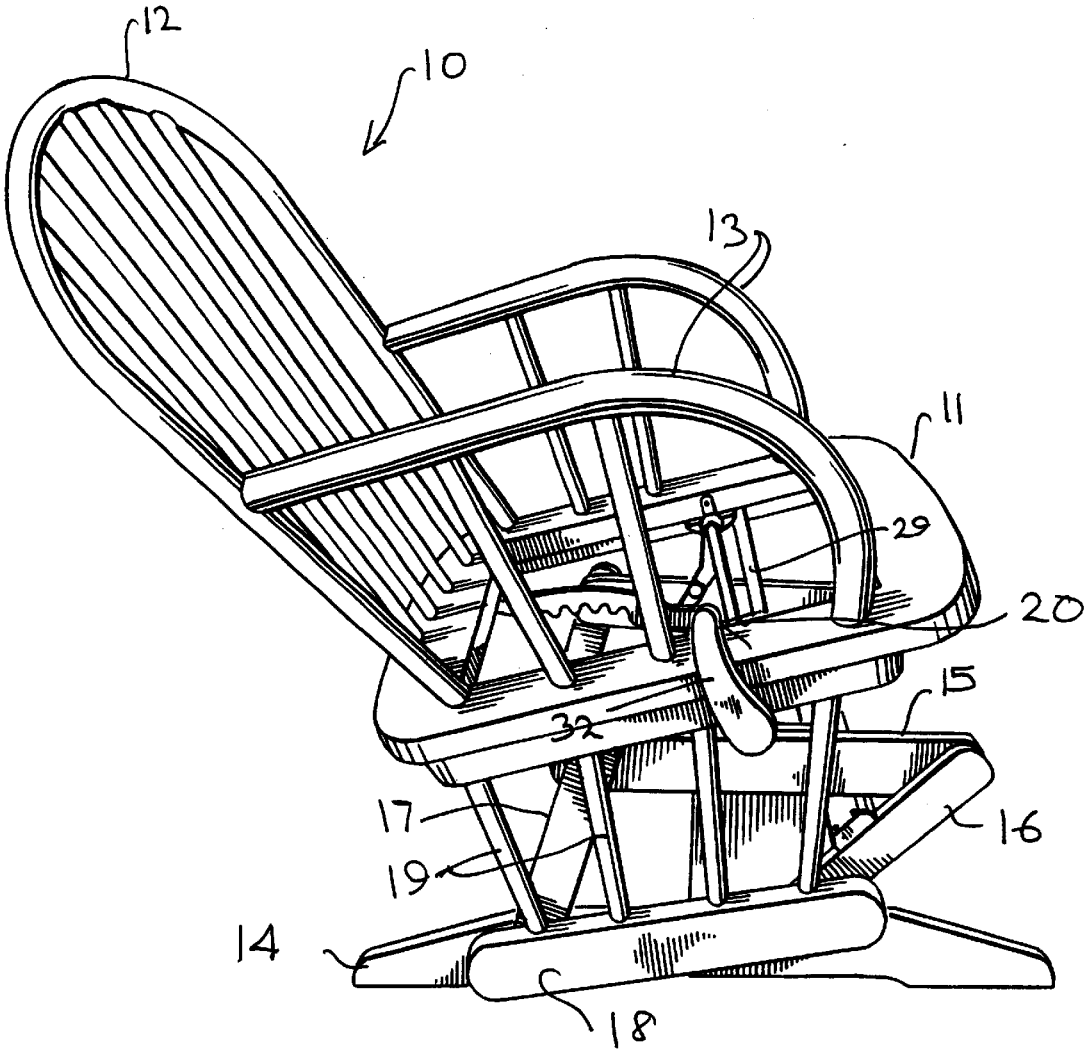
FIG. 1 is a top side perspective view of a rocking and gliding chair incorporating a locking mechanism in accordance with the invention.

The chair 10 shown in FIG. 1 is of the type known as a rocking and gliding chair and comprises a seat 11 supporting a back 12 and a pair of arms 13, the central area of the seat being omitted for ease of illustration. The chair base 14 has an elevated platform section 15 which on each side provides pivotal support for front and rear pivotal links 16, 17 respectively. At their lower ends these links are pivoted to respective side frame rails 18 on which the seat 11 is rigidly supported by means of spaced rods 19. As will be understood, the platform 15 together with the front and rear links 16 and 17 and the rails 18 form on each side of the chair a four bar linkage, the two linkages guiding the chair for a rocking and gliding movement relative to the base.

Figure 4:
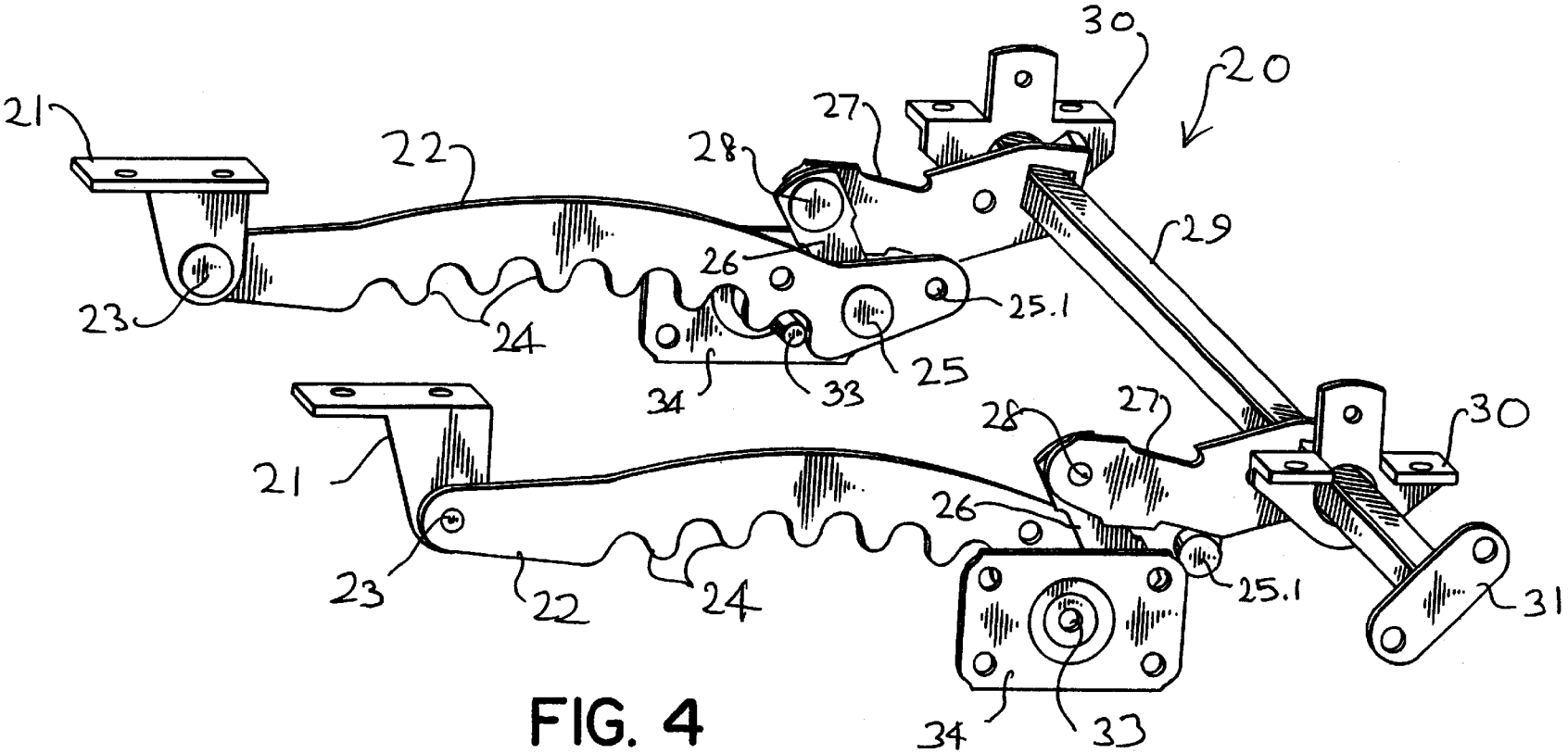
FIG. 4 is an isometric view of the locking mechanism hardware of the chair.

To provide for locking of the chair 10 relative to the base at different selected positions, a locking mechanism 20 (which is best seen in FIG. 4) is provided. The locking mechanism in FIG. 4 is shown isolated from the chair for clarity of illustration and comprises on each side a rear mounting bracket 21 for attachment on the underside of the chair seat 11 and an elongate toothed rack 22 having a rear end that is pivoted to the bracket 21 on a transverse axis by a pivot pin 23. The rack 22 is oriented in a vertical plane and is upwardly arched over its length, having on its underside a series of large rounded teeth 24. The forward end of the rack 22 is connected through a pivot pin 25 to an operating mechanism which comprises a pair of struts 26, 27 that are pivotally interconnected at adjoining ends by a pivot pin 28. Forwardly of the pivot pin 25, each rack 22 supports a laterally outwardly projecting abutment pin 25.1, the function of which will become clear as this description proceeds.

On each side the strut 27 is fixed at its other end to a transverse square shaft 29 the opposite ends of which are journalled in brackets 30 designed for attachment to opposite sides of the seat 11. One end of the shaft carries a plate 31 adapted to mount an operating lever 32 affixed thereto, in use the operating lever being disposed at the right hand side of the chair seat 11 in a position where it is convenient for manipulation by the occupant of the seat.

The locking mechanism also includes for each of the toothed racks 22 a corresponding locking pin 33 projecting laterally inwardly from a mounting plate 34 designed for attachment to the platform 15 of the chair. The various parts of the locking mechanism are fabricated in steel, and are conveniently attached to wooden portions of the chair by means of threaded screws (not shown).

The operation of the locking mechanism will now be described. With the pivoted rack 22 in its retracted position as shown in broken lines in FIG. 2, the teeth 24 of the rack are raised well clear of the pin 33 and therefore the rocking and gliding motion of the chair can take place without any interference from the locking mechanism. It will be noted that in this position the struts 27, 28 are folded relative to one another. When it is desired to lock the chair in a particular position within its range of movement relative to the base, the lever 32 is manipulated to rotate the shaft 29 which in turn unfolds the struts 26, 27 to a more straightened position thus effecting downwards pivotal movement of the toothed rack 22 in a vertical plane about the transverse axis defined by the rear pivot pin 23.

The two toothed racks 22 pivot in unison with the shaft 29 so that the teeth 24 thereof move simultaneously into engagement with the locking pins 33 which are fixed on the platform 15. Each of the racks 22 includes a series of teeth 24 extending along its length so that the tooth-to-pin engagement can be effected at selected positions throughout a relatively large range of movement of the chair relative to its base, as illustrated by the different positions of engagement seen in FIGS. 2 and 3. The pins 33 are of relatively large diameter, e.g. at least 0.25 inches, and are comfortably accommodated in the oversize teeth receptacles 24, the entire locking structure being of adequate strength to withstand the bearing and other loads imposed on the locking mechanism by the occupant by the chair.

Figure 2:
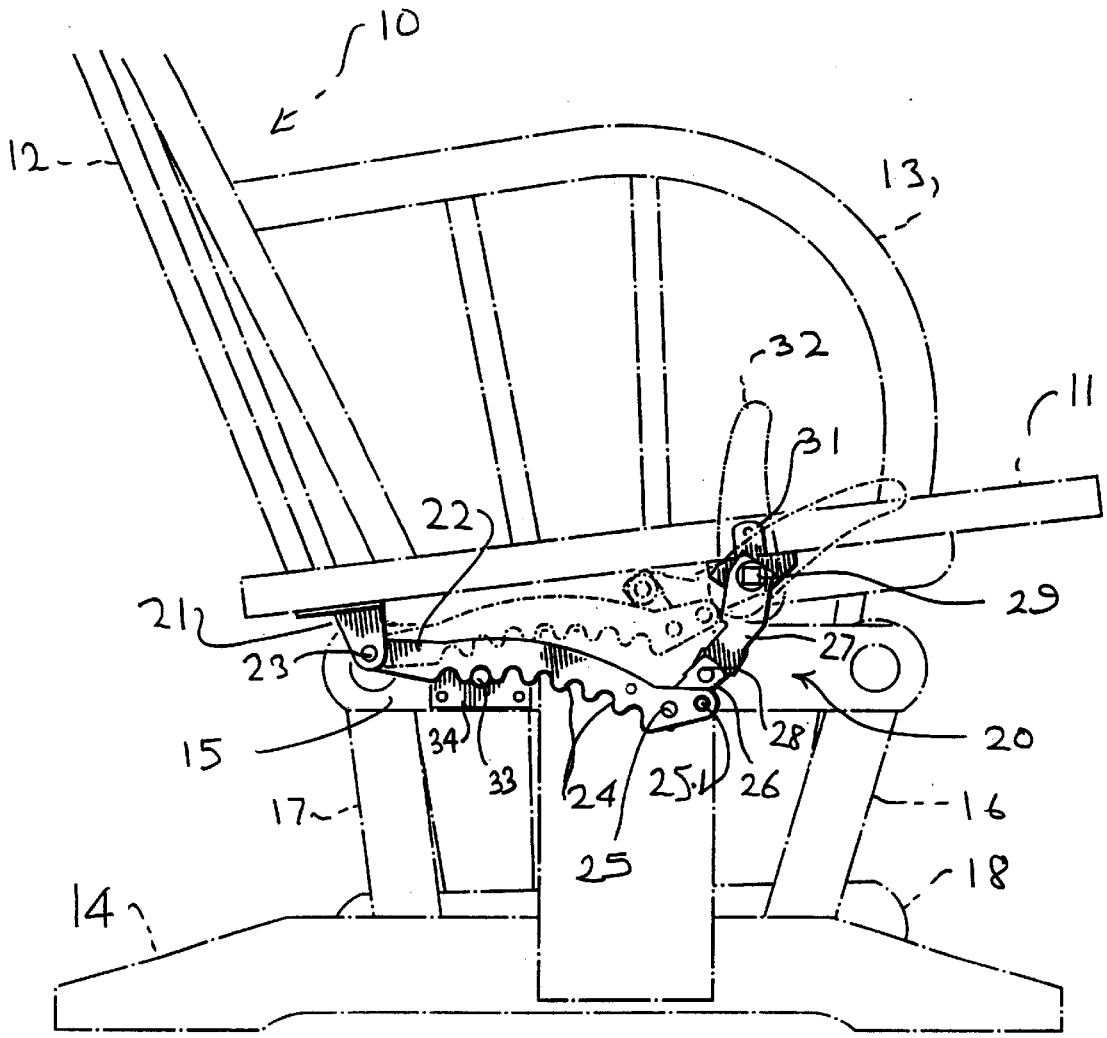
FIG. 2 is a somewhat schematic side elevation of the rocking chair of FIG. 1.
Figure 3:
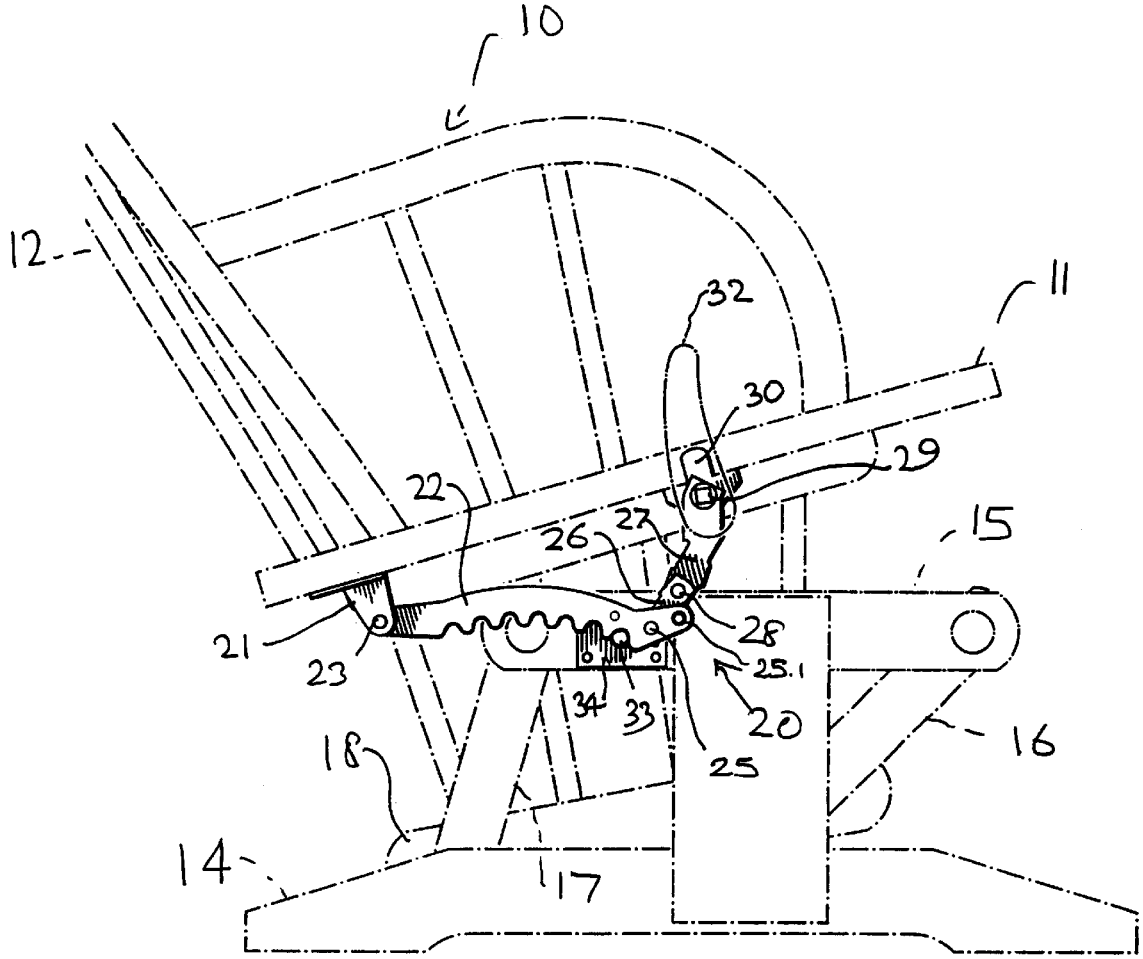
FIG. 3 is a view similar to FIG. 2 showing the chair in a alternative position.

As seen in FIGS. 2 and 3, in the locked position, the pivoted struts 26, 27 are in an over-center position so that the locking mechanism is stable when locked. In other words, since in moving to the locked position the axis of the pivot pin 28 has passed slightly beyond the plane containing the axes of the pivot pin 25 and of the square shaft 29, downward forces applied on the locking mechanism by the weight of the occupant in the chair will not tend to restore the locking mechanism to the retracted position. The locking mechanism is supported in the locking position by the abutment pin 25.1 at the forward end of each toothed rack 22, this abutment pin being positioned to be engaged by the strut 26 and provide support thereto.

When it is desired to release the locking mechanism, the operating lever 32 is swung (in a clockwise sense as seen in FIG. 2) to move the strut linkage 26, 27 back through the over-center position, whereupon it can easily be restored to the folded retracted position as shown in broken lines in FIG. 2. This unlocking movement can be performed even with an occupant seated in the chair since the mechanism is sufficiently strong and the lever 32 provides sufficient mechanical advantage to effect this unlocking movement against the imposed load.

We claim:

1. A chair, comprising:

a base for supporting the chair on a floor;

a seat positioned generally above said base and supported for movement thereon by a linkage connection;

a locking mechanism operable to immobilize said seat relative to said base, said locking mechanism including:

a) a retaining member mounted to said base;

b) an elongate member pivotally mounted to said seat at a first pivot axis, said elongate member defining an array of teeth spaced along its length, said elongate member in use extending generally in a direction of movement of said seat relative to said base and being of such length that throughout at least a major part of said movement, said retaining member lies in register with said array of teeth; and c) an actuating mechanism selectively operable to effect a pivotal movement of said elongate member towards said retaining member to lock said seat with respect to said base, said actuating mechanism including:

i) a lever mounted to said seat on one side thereof;

ii) an operating linkage controlled by said lever, said operating linkage including first and second struts having adjacent ends that are pivoted together on a second pivot axis, a second end of said first strut being pivoted on a third pivot axis to said elongate member, and a second end of said second strut being pivotally mounted on a fourth pivot axis on said seat, said struts being movable in respective planes substantially normal to said first pivot axis between a retracted position wherein said struts are folded at an acute angle about said second pivot axis and said teeth are spaced above said retaining member, and an extended position wherein said struts are extended so as to be substantially aligned with each other and a tooth of said elongate member lies in locking engagement with said retaining member.

2. A chair as defined in claim 1, wherein in said extended position said second axis lies in a slightly over-center position relative to said third and fourth axes such that a force exerted on said seat to urge said third axis towards said fourth axis does not act to restore said struts to said retracted position, said operating linkage including an abutment which is effective to support said struts in said over-center position.

3. A chair as defined in claim 2, wherein said elongate member is curved along its length presenting a concave side towards said retaining member.

4. A chair as defined in claim 1, wherein said elongate member is curved along its length presenting a concave side towards said retaining member.

5. A chair as defined in claim 1, wherein said base includes a platform, said linkage connection including front and rear links each having an upper end pivotally attached to said platform on respective horizontally spaced upper pivot axes, and each link having a lower end pivotally attached on respective horizontally spaced lower pivot axes to a rail that is attached to said seat, the spacing between a lower pivot axis of said front link and a lower pivot axis of said rear link being less than the spacing between an upper pivot axis of said front link and an upper pivot axis of said rear link.

6. A chair as defined in claim 5, wherein each of said front and rear links comprises a pair of laterally spaced members which are coaxially attached to said platform at opposite sides of said chair.

7. A chair as defined in claim 5, wherein said locking mechanism is adapted to form a locking connection between said seat and said platform on both lateral sides of said platform.

8. A chair as defined in claim 1, wherein said retaining member is a pin.

9. A chair as defined in claim 8, wherein said elongate member is a rack.

10. A chair, comprising:

a base for supporting the chair on a floor;

a seat positioned generally above said base and supported for movement thereon by a linkage connection;

a locking mechanism operable to immobilize said seat relative to said base, said locking mechanism including:

a) a retaining member mounted to said base;

b) an elongate member pivotally mounted to said seat at a first pivot axis, said elongate member defining an array of teeth spaced along its length, said elongate member in use extending generally in a direction of movement of said seat relative to said base and being of such length that throughout at least a major part of said movement, said retaining member lies in register with said array of teeth; and c) an actuating mechanism including:

i) a lever mounted to said seat on one side thereof;

ii) an operating linkage controlled by said lever, said operating linkage including:

1) first and second struts having adjacent ends that are pivoted together on a second pivot axis, a second end of said first strut being pivoted on a third pivot axis to said elongate member, and a second end of said second strut being pivotally mounted on a fourth pivot axis on said seat, said struts being movable in respective planes substantially normal to said first pivot axis between a retracted position wherein said struts are folded at an acute angle about said second pivot axis and said teeth are spaced above said retaining member, and an extended position wherein said struts are extended so as to be substantially aligned with each other and a tooth of said elongate member lies in locking engagement with said retaining member, in said extended position said second axis lying in a slightly over-center position relative to said third and fourth axes such that a force exerted on said seat to urge said third axis towards said fourth axis does not act to restore said struts to said retracted position;

2) an abutment for supporting said struts in said over-center position;

iii) said actuating mechanism being selectively operable to effect a pivotal movement of said elongate member towards said retaining member to cause engagement of said retaining member with a registering tooth of said elongate member and thus lock said seat with respect to said base.

11. A chair as defined in claim 10, wherein said elongate member is curved along its length presenting a concave side towards said retaining member.

12. A chair as defined in claim 10, wherein said base includes a platform, said linkage connection including front and rear links each having an upper end pivotally attached to said platform on respective horizontally spaced upper pivot axes, and each link having a lower end pivotally attached on respective horizontally spaced lower pivot axes to a rail that is attached to said seat, the spacing between a lower pivot axis of said front link and a lower pivot axis of said rear link being less than the spacing between an upper pivot axis of said front link and an upper pivot axis of said rear link.

13. A chair as defined in claim 12, wherein each of said front and rear links comprises a pair of laterally spaced members which are coaxially attached to said platform at opposite sides of said chair.

14. A chair as defined in claim 13, wherein said locking mechanism is adapted to form a locking connection between said seat and said platform on both lateral sides of said platform.

15. A chair as defined in claim 10, wherein said retaining member is a pin.

16. A chair as defined in claim 15, wherein said elongate member is a rack.

* * * * *